US011649698B2

(12) United States Patent
Schulte-Göbel

(10) Patent No.: US 11,649,698 B2
(45) Date of Patent: May 16, 2023

(54) SYSTEM WITH A GROUND DRILLING DEVICE AND AN INPUT DEVICE AND A METHOD FOR CONTROLLING AN OPERATION OF A GROUND DRILLING DEVICE

(71) Applicant: TRACTO-TECHNIK GmbH & Co. KG, Lennestadt (DE)

(72) Inventor: Stefan Schulte-Göbel, Schmallenberg (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 17/164,361

(22) Filed: Feb. 1, 2021

(65) Prior Publication Data

US 2021/0262319 A1 Aug. 26, 2021

(30) Foreign Application Priority Data

Feb. 4, 2020 (DE) ..... 10 2020 000 715.5

(51) Int. Cl.
*E21B 41/00* (2006.01)
*E21B 49/00* (2006.01)

(52) U.S. Cl.
CPC ..... *E21B 41/00* (2013.01); *E21B 49/003* (2013.01)

(58) Field of Classification Search
CPC ..... E21B 41/00; E21B 44/00; E21B 49/003; E21B 7/022
See application file for complete search history.

(56) References Cited

U.S. PATENT DOCUMENTS 5,937,954 A * 8/1999 Puttmann ..... E21B 7/068 175/231
6,079,506 A * 6/2000 Mercer ..... E21B 47/024 175/45
6,285,860 B1 * 9/2001 Szarka ..... H04B 1/46 455/66.1
6,308,787 B1 * 10/2001 Alft ..... E21B 44/00 175/48
7,884,736 B2 * 2/2011 Jin ..... E21B 44/00 175/45
8,272,467 B1 * 9/2012 Staab ..... G08C 17/02 701/50
9,725,879 B2 * 8/2017 Bystedt ..... E02F 9/205
(Continued)

FOREIGN PATENT DOCUMENTS

DE 202017003305 U1 * 11/2018 ..... E21B 41/0021
WO WO-2017069683 A1 * 4/2017 ..... E02F 9/085

*Primary Examiner* — Daniel P Stephenson
(74) *Attorney, Agent, or Firm* — Leason Ellis LLP

(57) ABSTRACT

A system comprising a ground drilling device with a control device, the system including an input device functionally coupled to the control device for entering at least one parameter for operating the ground drilling device. The at least one parameter may include a parameter that causes the ground drilling device to start drilling. The input device may be configured as a remote control with a feedback device, which outputs a variable that a user can perceive i) tactilely, ii) visually, and/or iii) auditorily, and that depends on a) the operation of the ground drilling device, b) the operating state of the ground drilling device, and/or c) the signal of a detection device.

20 Claims, 1 Drawing Sheet

(56) References Cited

U.S. PATENT DOCUMENTS

| | | | | |
|---|---|---|---|---|
| 2002/0195275 | A1* | 12/2002 | Brand | E21B 7/04 175/24 |
| 2003/0205410 | A1* | 11/2003 | Koch | E21B 7/046 175/45 |
| 2016/0076356 | A1* | 3/2016 | Krems | G05B 19/05 700/275 |
| 2019/0136489 | A1* | 5/2019 | Bolz | G05G 9/04 |
| 2020/0291770 | A1* | 9/2020 | Jostes | E21B 47/13 |
| 2021/0262319 | A1* | 8/2021 | Schulte -Göbel | E21B 41/00 |

* cited by examiner

SYSTEM WITH A GROUND DRILLING DEVICE AND AN INPUT DEVICE AND A METHOD FOR CONTROLLING AN OPERATION OF A GROUND DRILLING DEVICE

FIELD OF INVENTION

The invention relates to a system comprising a ground drilling device with a control device, wherein the system also has an input device functionally coupled to the control device for entering at least one parameter for operating the ground drilling device. The invention also relates to a method for controlling the operation of a ground drilling device.

BACKGROUND

Ground drilling devices are normally operated by a user who is positioned in a driver's cab, usually an operator's cab. The driver's cab has a seat for an operator, who can control the operation of the ground drilling device by using at least one actuating element, particularly a multifunctional joystick. Besides the operator, other people are usually required on site to monitor and/or carry out the operations and a successful outcome, or the activities required for the drilling.

If an input device designed as a remote control is used to operate the ground drilling device and the user is not in the driver's cab, the user basically lacks all the impressions they could have gained in the driver's cab up to that point, so they can be involved in the ground drilling process.

SUMMARY

Therefore, the invention aims to provide a system and a method with which the user is "physically" involved in the drilling process, even if the user uses a remote control as the input device for controlling or commanding the drilling while distant from the ground drilling device.

That objective is achieved by the subject matter of the independent claims. Advantageous embodiments are the subject matter of the respective subclaims and the description.

The invention's core idea is to output to the user or operator (the terms are synonymous) a tactilely, visually, and/or auditorily perceivable variable that essentially depends on the impressions normally obtained in or at the driver's cab of the ground drilling device. This gives the user the opportunity to "experience," "perceive," or "feel" what is recorded in or at the driver's cab. For example, impressions of the movement of the ground drilling device and/or the drill rod, or reaction forces caused by inserting the drill rod, which were previously perceived in the driver's cab, can be transmitted to the user through the tactilely, visually, and/or auditorily perceivable variable. This gives the user the "knowledge" of or a "feeling" for the progress and/or obstacles in the drilling process, which they would otherwise have received from their perceptions in the driver's cab. The user is personally involved through the tactilely, visually, and/or auditorily perceivable variable. Safety regulations can be satisfied through the variable that the user can perceive on the input device, particularly if the variable provides feedback on the movement of the drill rod and/or the ground drilling device due to the reaction forces caused by inserting the drill rod and the user cannot see or "feel" the ground drilling device. The ground drilling device can be prevented from entering an undesirable operating state; the ground drilling device itself can be protected; serious damage to the ground drilling device can be avoided. The feedback device gives the user a feeling similar to that in the driver's cab.

Therefore, the output of the variable can be adapted in the broadest sense to the user's perception that they would have in or close to the driver's cab. For example, it is possible that the variable is only outputted or is only outputted in amplified form when a change in a normal state occurs, particularly a change that the user would normally have perceived in the driver's cab. A possible change can be a (beginning) movement of the ground drilling device, which can affect a movement of the driver's cab. A movement of the driver's cab or the start of a movement of the driver's cab can be outputted to the input device by means of a variable that can be perceived—especially tactilely—by the user. A movement of the ground drilling device can be caused by reaction forces that can be caused by a movement of the drill rod. The user, who perceives an incipient movement in a driver's cab, can normally act on the operation of the ground drilling device in such a way that the pushing or pulling force and/or the torque which is or will be applied to the drill rod is cancelled. In the driver's cab, the user can perceive an increasing power of the engine, which can now be brought to their attention when using the input device with the output of the perceivable variable. Even when the input device is used as a remote control, the user can receive impressions that the input device can transmit to them, which they would otherwise perceive in or at the driver's cab. In particular, the perceivable variable can relate to deviations from normal operation.

Although configuring the input device as a remote control creates the possibility that the operator previously provided for in the driver's cab can choose their location more freely regarding the control of the ground drilling device, it opens up the possibility of perceiving impressions previously gained at the driver's cab after they have been converted into the tactilely, visually and/or auditorily perceivable variable. The company using the ground drilling device might benefit in another way, since some of the impressions can be transmitted to the previous users (who were accustomed to controlling the ground drilling device from the driver's cab) regardless of the operating location, and it won't be too difficult for them to adjust to the change, particularly if a tactilely perceivable variable is outputted—especially one that is otherwise perceived in the driver's cab as movement of the ground drilling device. The acceptance of an input device configured as a remote control can be increased.

The invention provides a system comprising a ground drilling device with a control device. Furthermore, the system has an input device functionally coupled to the control device for entering at least one parameter for operating the ground drilling device, particularly a parameter that causes the ground drilling device to start drilling. The input device is designed as a remote control with a feedback device, which outputs a variable that a user can perceive i) tactilely, ii) visually, and/or iii) auditorily, and that depends on a) the operation of the ground drilling device, b) the operating state of the ground drilling device, and/or c) the signal of a detection device.

For the purposes of the description, a "ground drilling device" is any device which moves a drill rod with rod sections into an existing channel in the ground (or a channel that is to be created) in order to create or widen a drill hole, particularly a horizontal drill hole (HD), or to insert pipelines or other long objects into the ground. The ground drilling device can be an HD device. For the purposes of the description, the term "HD" (horizontal drilling) particularly means an at least partially horizontally arranged drill hole, channel, or pipeline. A ground drilling device can thus be a device driving a drill rod, which works to displace the soil and which inserts the drill rod into the earth in a translatory and/or rotary manner in the longitudinal axial direction of the drill rod. A drill hole can be made in the ground by pushing or pulling the drill rod. For the purposes of the description, the term "rod section" entails, in a non-exclusive manner, rigid, individual force transmission elements that can be connected directly or indirectly to each other and used in a ground drilling device.

A front section of the drill rod can be designed as a drilling head or drilling tool. The drill rod can also have a probe housing, particularly in a front area.

For the purposes of the description, the term "control device" means a control system that can be used to directly influence the ground drilling device during its operation (meaning, during the implementation of the ground drilling, or to start or stop the drilling). The control device can be designed electrically or electronically. The parameters entered by the operator can be used by the control device—optionally after being converted and/or processed into electrical signals—as inputs for operating the ground drilling device. The ground drilling device can thus be operated or controlled by inputting a parameter that may have been converted into an electrical signal.

For the purposes of the description, a "parameter" means an input that can directly influence the operation of the ground drilling device. The parameter can be transmitted to the control device as an input signal that the device then uses to control the operation of the ground drilling device. For example, a parameter can cause the ground drilling device to start or stop drilling. For example, an operator can enter the "Start" parameter, after which an input signal linked to the input will be transmitted to the control device and cause the drilling to start. Likewise, an operator can enter the parameter "Stop," and a corresponding input signal connected to it can be transmitted to the control device, causing the ground drilling device to stop drilling. Other parameters can influence or change the operation of the ground drilling device; those parameters can be entered by an operator, converted into an input signal by the input device, and transmitted to the control device.

For the purposes of the description, the term "input device" means any electrical or electronic device that is suitable for converting an operator's input into an electrical signal that can be transmitted to the control device—without being processing further or via the processing of the signal (particularly, processing in one or several circuits, such as in a booster)—to serve as input or an input signal of the control device. The input device can be understood as an interface between an operator and the control device. The input device can have a portable power supply, particularly in the form of one or more batteries, accumulators, or the like.

In particular, the input device can have a processor that is designed as a calculator with electronic circuits in order to execute commands. The processor can be programmed, and is designed to process commands. The input device can have an operating system that can be modified (to improve it and/or to adapt it to changes in a ground drilling device, for example). A modification of the operating system can be allowed in particular only if a password and/or the input device is connected to an interface of a computer, a dongle, or the like. In particular, the processor can recognize, request, process, and forward input from an operator in the form of parameters and/or process a program's additional commands. The processor can run a program that requests or receives input from an operator, processes that input, configures settings for that input, transmits the input to the control device and/or receives, processes and/or implements signals from the control device.

For the purposes of the description, the term "functionally coupled" means a connection of the devices mentioned (particularly a connection that is unidirectional or bidirectional), in particular to provide signals from one of the devices, in particular the input device, and to receive and/or process received signals with the other device, in particular the control device. The functional coupling can take place directly or indirectly through the interposition of additional elements or devices.

For the purposes of the description, a "remote control" means an electrical or electronic hand-held device that is suitable for controlling the operation of the ground drilling device while distant from that device by entering a parameter. For the purposes of the description, "while distant from the ground drilling device" means that direct input by the user by means of a device attached to the ground drilling device is not necessary or not possible. In particular, an operator outside the driver's cab of the ground drilling device can control the operation of that device by entering a parameter for operating it.

For the purposes of the description, the terms "tactilely perceivable variable," "visually perceivable variable," and "auditorily perceivable variable" mean a stimulus that affects or can by perceived by the corresponding sense (touch, sight, or hearing). The stimulus in the sense of touch can be perceived by touching or feeling, by a change in touching or feeling, and by holding. The vibrations, shocks, and movements of a held element, particularly the input device, are examples of tactilely perceivable variables. The visual stimulus can be perceived or responded to by means of an indicator on or next to the input device. The indicator can be any device that gives an optical signal. The indicator can convey variable information. The indicator can have different designs and be based on different technical implementations. The indicator configured for the optical information can be configured as a mechanical indicator, electromechanical indicator, electrical indicator, or electronic indicator. The indicator can be designed in the form of a display, one or more illuminant(s) with an invariable color, and/or one or more illuminant(s) with a variable color. Alternatively or additionally, the indicator can be configured as a projection display. Possible illuminants can be arranged in columns, rows, or both. Alternatively or additionally, the indicator can be designed as a scale indication or numeric indication in which the deflection of the pointer or the size of the number displayed corresponds to the intensity or size of the variable to be perceived. The auditory stimulus can be perceived or responded to by means of an audio signal outputted via a sound generator. The sound generator can be a loudspeaker.

The output of the variable is adapted to the type of sense responded to by the user. The variable can be "quantifiable" in terms of the stimulus perceived with the sense. The variable can have an intensity that corresponds to what the user usually perceives at the driver's cab. For the purposes of the description, the term "intensity" includes (particularly with the tactile, auditory, or visual stimuli) the possibility that a perceived variable (here, for example, a movement), a sound volume, a tone frequency, a repetition frequency of a sound signal, a brightness of a light signal, a frequency of a light signal, or a coloration of the light signal is pronounced or selected with different strengths.

It can be provided that the perceivable variable can be perceived continuously by the user and that the intensity, deflection, or representation of the variable to be perceived changes when a deviation or event occurs. If a perceivable variable is to be outputted continuously, a safety concept can be pursued to the effect that if the perceivable variable is not outputted, the user is informed that, under certain circumstances, proper operation may not be possible or the connection between the input device and the control device of the ground drilling device should be checked.

For the purposes of the description, the term "variable perceivable by the user" particularly depends on a) the operation of the ground drilling device, b) the operating state of the ground drilling device, and/or c) the signal from a detection device. Regarding the dependency of the perceivable variable, the three aspects named are listed (some dependencies might be allocable to more than one of those aspects). For example, the environment that a user can feel in or at the driver's cab includes the reaction forces which act on the drill rod, the drive of the drill rod, and the ground drilling device when the drill rod is inserted; those reaction forces, which the user can perceive in or at the driver's cab, can be allocated to the operation of the ground drilling device (the ground drilling device is currently working in idle or standby mode (aspect a)), but also to the device's operating state (how the ground drilling device is working: drill rods penetrate hard earth with a high operating load of the drive (aspect b)). Aspect c) can take precedence over the other aspects, since a detection device can detect both the operation (aspect a) and the operating state (aspect b).

For the purposes of the description, the term "detection device" means a device which is designed to detect a state. For the purposes of the description, the state can be any state that is associated with performing a ground drilling with the ground drilling device. The state does not necessarily relate to the operation or an operating parameter of the ground drilling device, but can also include detecting a person in the danger zone of the ground drilling device or an object in the area where the ground is being drilled, during the planned course of the ground drilling. The detection device can be designed to detect a state of a device next to, in, or near the ground drilling device and/or a drilling head tip. For example, the detection device can have a sensor that is selected to be suitable for detecting the state and is positioned at a suitable point. For example, the engine power and/or the hydraulic pressure of the ground drilling device can be detected. A signal can be outputted by a sensor that detects the corresponding variable if the engine power and/or the hydraulic pressure exceeds a certain threshold value and/or an increase or decrease in the form of a slope or gradient of the variable to be detected (such as the engine power or the hydraulic pressure) is detected. Alternatively or additionally, it can be provided that the sensor transmits the recorded value to the control device, which compares it with the respective threshold value to decide whether a perceivable variable or a changed perceivable variable is outputted to the input device. One or more of the following (recordable) pieces of information or measured values are suitable for recording: power of an engine of the ground drilling device; hydraulic pressure of the ground drilling device; temperature of the engine and/or hydraulic temperature; movement of the drill rod, driver's cab, and/or ground drilling device; the presence of a person in the area of the ground drilling device, in particular in its danger zone; and the presence of an obstacle or an object (external line and/or rock) in the area of the drilling head tip, which can be detected in particular by a sensor in the area of the drilling head tip.

For the purposes of the description, the aspect described as "a) dependence on the operation of the ground drilling device" includes all processes, states, and/or parameters that the elements of the ground drilling device can take on during operation under load and/or without load.

For the purposes of the description, the aspect described as "b) dependence on the operating state of the ground drilling device" includes all processes, states and/or parameters that the elements of the ground drilling device can take on, particularly under load. If an operating state is changed or changes (movement of the drill rod and/or the ground drilling device; engine power; hydraulic pressure, etc.) above a threshold value, or an increase in the form of a slope or gradient, and/or an event occurs (ground drilling device begins to move; a person is in the danger zone), the variable to be perceived is affected in such a way that it changes.

For the purposes of the description, the aspect described as "c) dependence on a signal from a detection device" means the effect that a signal from a detection device (for detecting whether a ground drilling device is starting to move and/or whether a person is in the danger zone) indirectly or directly has on the output of the variable to be perceived. The current size of a parameter to be entered into the input device can be measured or recorded by a detection device.

The feedback device can be mechanically connected to the input device (particularly from the outside) for outputting a variable the user can perceive, or can be arranged in the housing of the input device so that the user can perceive the perceivable variable immediately when holding the input device and/or looking at the input device.

The feedback device can generate a perceivable variable that is generated depending on a variable that is usually perceivable at the driver's cab (such as a variable that is proportional to the movement of the ground drilling device and/or the drill rod). A variable might be outputted that depends on at least one of the three described aspects and is outputted in terms of its intensity or perception in such a way that the outputted variable describes a deviation from a normal state in its output. The outputted variable can also indicate the distance between the drilling head tip and an obstacle or an object in the ground, so that the variable's intensity depends on the distance between the drill head tip and the obstacle or object.

The feedback device can be present, for example, as a separate addition to or extension of the input device and in particular can be detachably or permanently connected to the input device to provide the perceivable variable to the user. If the user doesn't want or need any feedback, they can use a detachable connection to do without the additional weight and volume caused by the feedback device. If that user (or a new user of the input device) wants the feedback, they can reattach the feedback device. For example, the feedback device can be inserted into or removed from a compartment or slot in the input device provided for this purpose, as an additional device. Alternatively or in addition, it can be provided that a feedback device is integrated into the input device (particularly within its housing). It is possible for the feedback device to be present within a separate housing section of the input device; for the purposes of the description, "integration" means the possibility of providing a unit comprising an input device and a feedback device without a separation being recognizable from the outside.

In a preferred embodiment, the system has a movement sensor on the drill rod or the ground drilling device or both; if the movement sensor is arranged on the ground drilling device, it can be attached to the driver's cab or the carriage of the ground drilling device or both, wherein the movement sensor with the feedback device is functionally coupled to send the feedback device a signal relating to a movement detected on the drill rod or the ground drilling device or both. For the purposes of the description, the term "movement" also means vibration (meaning movement back and forth) or shock. The movement, vibration, shock, etc. detected by the movement sensor is recorded and evaluated depending on the type, intensity, and/or direction in order to output the perceivable variable depending on this. In particular, it is possible to detect a movement in different spatial directions and to determine a deviation from the normal movement, which can also include a "state of rest." For example, one or more movement sensors can detect the movements in at least one spatial direction and preferably in at least one additional spatial direction that differs from the first spatial direction and can be compared with the parameters entered at the control device. Different spatial directions can encompass an angle between them which is not equal to 0° and is preferably between 70° and 90°. In a preferred embodiment, a right angle can be encompassed between the spatial directions. A transmission via CAN bus to the control device, in which an evaluation can optionally be carried out, is possible. A deviation from the usual movement predetermined from the parameters can be detected and a variable corresponding to the deviation can be outputted.

For the purposes of the description, the term "movement sensor" means a sensor that can detect movement. A "movement" particularly means a change in position. A rotation of the drill rod can also be understood as a movement of the drill rod, so that a rotation can also be outputted as a perceivable variable. In particular, the movements that are detected by the movement sensor can occur with changing soil conditions, meaning a change in clay, rock, and/or sand soils.

The movement sensor can send the control device a signal regarding the movement. The control device can in turn send the signal, or a modified signal that depends on the received signal, to a gateway. That gateway can then send the received signal or a modified signal to the input device. The perceivable variable can then be outputted at the input device, depending on the movement of the drill rod (which is correlated with the received signal), particularly in the form of a tactilely perceivable variable. It can be particularly provided that the signal from the motion sensor is evaluated in the control device. The motion sensor can transmit the signal to the control device by cable or wirelessly or both. In particular, the machine gateway can send the data wirelessly to the input device. Insofar as the "sending" process is described in the description, that process also entails a "receiving" process in which the "receiving unit" retrieves the signal or a parameter from a memory.

In a preferred embodiment, the feedback device is a vibration device. It can be provided that in a "normal operating state" a vibration of medium intensity is perceived tactilely. If the drill rod hits rocky ground, the intensity of the vibration can increase. If the drill rod continues to slow down after hitting the rocky ground, the intensity of the vibration can be increased further to indicate that the ground drilling device might be approaching an undesirable state.

In a preferred embodiment, when the drill rod moves, the feedback device outputs a continuously (and preferably tactilely) perceivable variable. The feedback device can vibrate continuously, for example. A vibration can correspond to a normal operating state of the ground drilling device.

In a preferred embodiment, the feedback device is arranged at least partially in a grip section of the input device so that the feedback device can be connected directly to the user. The section of the input device gripped by the user can directly convey a tactilely perceivable variable.

In a preferred embodiment, the input device has two feedback devices. This increases safety, for example, since, if one feedback device fails, another one is still available. Furthermore, when at least two feedback devices are provided, one feedback device can be arranged in each corresponding grip section of the input device. A feedback device can thus be provided in each grip section of the input device. An essentially synchronous application of the feedback devices or synchronous output of the perceivable variable of each of the feedback devices can be preferred. It can also be provided that the at least two feedback devices are designed for the output of two different perceivable variables. However, it can also be the case that the two feedback devices are designed to respond to the same stimulus from the user. For example, one feedback device can output a variable that depends on the movement of the drill rod, meaning the feedback device reflects the movement (linear movement and/or rotation) of the drill rod; an additional feedback device can output a variable that depends on the movement of the ground drilling device, meaning the additional feedback device reflects the movement of the ground drilling device. It is also possible that, with at least two feedback devices, one feedback device outputs a variable that depends on the linear movement of the drill rod and the other feedback device outputs a variable that depends on the rotary movement of the drill rod.

The invention also provides a method for creating a ground drilling by means of a ground drilling device having a control device, wherein at least one parameter is entered for operating the ground drilling device, in particular a parameter which causes the ground drilling device to start drilling, at an input device functionally coupled to the control device, which is distant from the ground drilling device. A variable that a user can perceive is outputted; that variable depends on the movement of the drill rod and on a) the operation of the ground drilling device, b) the operating state of the ground drilling device, and/or c) the signal from a detection device.

The invention has been described in terms of the aspect of a system and the aspect of a method. The explanations or statements in the description relating to the aspect of the system and the aspect of the method complement one another. For example, method steps particularly result from the explanations and statements relating to the system.

The input of the at least one parameter can (a) set a torque and/or rotational speed applied to a drill rod of the ground drilling device, (b) set a linear feed force and/or a linear feed rate applied to a drill rod, (c) set a stroke frequency of a plunger, (d) set a stroke amplitude of a plunger, (e) set a flow rate and/or pressurization of a flushing liquid, (f) perform a rod change, (g) perform a rod lubrication, and/or (h) change a drilling head type. To that end, it can be taken into account which rod is involved. Particularly in the case of a double rod system, the torque and/or rotational speed can be selected independently for an inner rod system, so that for a double rod system, both the torque and/or the rotational speed for the inner rod system and/or the outer rod system can be set. In this way, essentially any input can be made that may be relevant for the drilling operation of the ground drilling device. Besides starting or stopping the ground drilling device from drilling, the aforementioned parameters can be transmitted to the control device.

For setting a torque/rotational speed applied to the drill rod in the ground drilling direction, the control device can transmit a signal to the drive of the ground drilling device, which is connected to the drill rod, depending on the parameters entered by the operator using the input device, so that the torque/rotational speed selected by the operator can be set. The parameter can be a signal that corresponds to the variable of the torque/rotational speed. The setting of a linear advance of the drill rod can be used to set both the force or the pressure and/or speed with which the drive acts on the drill rod connected to the drive. Setting the linear feed can also include whether the linear feed is a pulling or pushing force, meaning whether the drill rod is being pulled or pushed through the earth. In this respect, the term "feed" includes both directions—both pulling and pushing the drill rod—so that a pulling or pushing force can be applied to the drill rod. The parameter can thus be a signal that corresponds to the pushing or pulling force. When drilling a hole in the ground, flushing liquid (particularly in the form of bentonite) can be used. The flushing fluid can be passed through the drill rod and exit in its front area. A flow rate/pressure of the flushing liquid can be set as a parameter, which can be adapted to the conditions in the ground. When drilling with a drill rod, it is necessary during the ground drilling to lengthen the drill rod, wherein, in particular, additional rod sections are connected to the drill rod that has already been drilled in the ground. To that end, an input may be required that performs a rod change with the drill rod that has already been drilled (meaning, connecting an additional rod section, particularly from a rod magazine). The parameter can thus be an actuation that corresponds to the command "Change rod now." When the rods are changed, the drill rod that has already been drilled into the ground can be clamped to fix its axial and/or angular position. Entering the parameter can also include changing the drilling head type, which may be necessary in particular if, after a pilot bore has been carried out (meaning creating an initial bore hole, for example, by pushing into the ground), the drilling head type is changed to an expansion drilling head that is pulled through the previously created pilot bore hole to expand it.

If the ground drilling device is designed as a percussion drilling device, the impact frequency of the main piston of the percussion drilling device and/or the impact amplitude of the main piston of the percussion drilling device can be set. For the purposes of the description, the terms "percussion drilling device" and "displacement hammer" (which are essentially synonymous) include a self-propelled impact device which works to displace the ground and can insert a cable or a pipe into the ground by striking the ground. The term "percussion drilling device" can include a ground drilling device in which the drilling head tip is arranged in a housing so that it can move longitudinally. The drilling head tip can be a chisel in particular. A percussion drilling device can be both a one-stroke device and a multi-stroke device. With a one-stroke device, the main piston hits the drilling head tip and the housing at the same time. With a multi-stroke device (particularly a two-stroke device), the main piston first hits the drilling head tip, which thus runs ahead during the first stroke. The main piston acts on the housing in a subsequent stroke (particularly a second stroke). With a multi-stroke device, the tip resistance and surface friction can be separated from one another and thus be overcome more easily.

The input device can have at least one mechanically operable actuating element. The mechanically operable actuating element can be any mechanically or manually operable actuating element. A rotary adjuster, a control stick, and/or a push button are preferred embodiments of a mechanically operable actuating element. Different types of actuating elements are possible on the input device. Several similar actuating elements can be provided on the input device.

For the purposes of the description, a control stick is an actuating element for inputting two-dimensional signals in particular. A control stick can have an element that extends from a surface and can generally be tilted in several directions. The element can be particularly designed in the shape of a rod, a stamp, a stick, or a lever. The element can extend from an area at a height which does not exceed 7 cm, more preferably 6 cm, more preferably 5 cm, more preferably 4 cm, more preferably 3 cm, more preferably 2 cm, more preferably 1 cm. The diameter of the element can in particular be less than 5 cm, more preferably 4 cm, more preferably 3 cm, more preferably 2 cm. For the purposes of the description, a control stick can also be referred to as an analog stick or joystick and can have the same function. The term "control stick" also includes a control pad with which two-dimensional signals can be entered. The control stick generates a signal that depends on the position of the element or the control pad in relation to a standard or resting position of the element or the control pad. It can be provided that the control stick delivers individual electrical signals when actuated and/or continuously delivers an electrical signal in the form of voltages and/or currents, wherein one potentiometer can be used for each of the dimensions in which the element or the control pad can be tilted; for example, one potentiometer for the top/bottom position and one potentiometer for the left/right position. Changing the position or location of the control stick's element or control pad in relation to the resting or standard position can change the voltage. The size and/or arrangement of the control stick on the input device can be designed so that an operator can actuate it with their thumb and/or finger, and in particular can actuate it without relocating their hands. If it is implemented that the control stick is designed to generate signals that depend on a movement in at least two dimensions, this also includes the option of providing an input for controlling the operation of the ground drilling device by means of a control stick, in which the control stick does not generate any signals regarding the movement in one of the dimensions, and/or signals regarding the movement in one of the dimensions are not or do not need to be taken into account by the control device.

For the purposes of the description, a rotary adjuster or rotary knob can have a potentiometer or be formed by this. Advantageously, the rotary adjusters are essentially maintenance-free and insensitive to vibrations; furthermore, rotating the rotary adjuster in the switched-off state might have no effect.

A push button in the sense of the description is an actuating element that can be designed as an assembly that establishes or disconnects an electrically conductive connection. The push button can be designed as a toggle switch or as a simple push button switch. It has been found that it is advantageous that an actuation stroke of a push button should be at least more than 2 mm to be regarded as an "intended" actuation. Actuation strokes of more than 2.3 mm are preferred, wherein with gloves, actuation strokes of more than 3 mm, preferably more than 5 mm, more preferably more than 6 mm, even more preferably more than 7 mm can be provided. It has proven to be advantageous that the diameter of a push button should be more than 5 mm, in particular more than 7 mm, for actuation by means of an operator's finger. When operated by an operator's thumb, the diameter of a push button can advantageously be more than 15 mm, preferably more than 17.5 mm, more preferably more than 20 mm.

A selection of mechanically operable actuating elements can be provided on the input device. In particular, actuating elements that are customary in the prior art can be used in order to allow the operator the otherwise also customary input option for controlling the ground drilling device. The size and/or arrangement of the actuating elements can vary compared to the prior art: in particular, a control stick on the input device can be designed to be smaller than a multi-function joystick arranged in the driver's cab.

At least one mechanically operable actuating element, in particular a control stick, can be arranged as an exchangeable unit in a receiving space of the input device. This creates the possibility that an actuating element required to operate the ground drilling device can be exchanged quickly so the operator can operate the ground drilling device as continuously as possible. Such a simple exchange can be advantageous due to the operation of the input device outside the driver's cab, since the actuating element can be exposed to greater wear.

The sensitivity of the mechanically operable actuating element can be set (a) mechanically and/or (b) by means of software that is functionally coupled to the actuating element by means of a sensor and a counter element. This allows an operator to set the sensitivity, particularly that of a control stick or rotary adjuster, even under different conditions (with or without gloves, for example). For example, two different settings are possible for the sensitivity of a control element: 1) it is operated with gloves or 2) it is operated without gloves. It can also be provided that the sensitivity can be set depending on the type of input or parameter. The setting can be made by the processor in the input device.

The input device can have a circumferential outer contour, particularly an interrupted or closed one, which can envelop an inner contour or an interior of the input device. The circumferential outer contour can be essentially rectangular, square, polygonal, round, circular, and/or elliptical over the entire area or only in sections. Mixed forms and combinations of the aforementioned shapes are possible. In particular, it can be provided that the input device is essentially rectangular or cuboid and has a dimension ranging from 15 cm to 50 cm (preferably 20 cm to 40 cm) wide, 10 cm to 30 cm (preferably 15 cm to 25 cm) long, and 3 cm to 15 cm (preferably 5 cm to 10 cm) high.

It can be provided that the input device has at least one protrusion or several protrusions, particularly two, particularly regarding one of the aforementioned shapes, which can be designed to be gripped by the operator's hands (in particular, the protrusion(s) can be designed like a handle). The protrusion(s) can be designed as handle sections. A handle-like configuration or a configuration as a handle section that can be enclosed by the operator's hand can be preferred. The protrusion(s) can protrude from the rectangular, square, polygonal, round, circular, and/or elliptical shape of the input device. In particular, the mechanically operable actuating elements can be formed on one or each of the protrusions. The protrusions can be formed on the input device in such a way that a surface facing the operator is produced by means of the protrusion(s), which results in a surface that can in particular lie in one plane. It can be provided that the protrusions protrude on a surface with an aforementioned shape, particularly to form a receptacle, particularly having the circumferential outer contour, for a display device described in the description below, in full or in sections. The protrusion(s) can protrude across from a base surface or a base plate. The protrusion(s) can form, at least in sections, an edge on a base plate which forms the above-mentioned shape. The protrusion(s) can be offset to the front with respect to the base plate. If there are several protrusions, the protrusions can project in the same direction with respect to a base surface or base plate and form an edge on this. The base plate with the protrusion(s) can in particular reproduce an outer circumferential contour of a display device in sections. The base plate can be completely closed or have openings. At the edge of the base plate, a wall can project at least partially or in a closed manner, and can surround a display device described below in the description, at least in sections or completely around the circumference.

The protrusions can be curved (relating to their corners in particular) to adapt to the shape of the operator's hands. The respective protrusion can be adapted to the dimensions of an operator's hand; as a result, the input device in the other areas can be designed independently of the dimensions of the operator's hands; it is possible that an adaptation to the dimensions and shape of the hands is only given in the area of the protrusions. An adaptation to the shape and/or dimensions of the operator's hands, which can mean a reduction in the structural shape, can thus be related only to the protrusions.

The said protrusion(s) can have a diameter in the range of 3 cm to 5 cm, preferably 3 cm to 4 cm, for a good grip by an operator's hand. The length of a protrusion can be designed to be greater than 10 cm, preferably greater than 15 cm, so an operator can hold it well in their hand (particularly, without fatigue), to also take into account, for example, that the operator is wearing a glove.

If more than one protrusion is formed on the input device, the protrusions can be configured on opposite sides of the input device. A mirror-symmetrical arrangement of the protrusions is possible. The mechanically operable actuating elements can be designed mirror-symmetrically to one another at the protrusions when a plurality of protrusions are provided.

If the respective protrusion is gripped by the hand of the operator intended for it, a control stick can be arranged on the protrusion in the thumb area. A control stick is preferably arranged in the thumb area on each of the protrusions. A mechanically operable actuating element designed as a control stick preferably rises from an essentially flat or non-curved surface. The control stick can rise from a surface of the input device facing the operator. In particular, a control stick can rise from a surface that is parallel to the base surface of the input device, which can be defined essentially by the outer circumferential contour.

If a control stick is provided on the input device, a further mechanically operable actuating element, particularly a rotary adjuster, can be arranged on a surface of the protrusion that is different from the surface for the control stick. Independently of the provision of a control stick, a rotary adjuster can in particular be arranged on a surface of the protrusion that extends away from the operator. The surface on which a rotary adjuster is arranged can enclose an angle of 10° to 60°, preferably 20° to 50°, in particular with a surface that faces the operator when they are holding the input device or on which a control stick is provided. In particular, the rotary adjuster can be arranged so the operator can actuate it easily with their index or middle finger while holding the input device, particularly when they grip the possibly provided protrusion on the input device.

If a control stick is provided on the input device, a push button in particular can be arranged on a different surface provided for the control stick. A push button can in particular be arranged on a surface of the protrusion that extends away from the operator when they are holding the input device. If a control stick is provided, the surface on which the push button can be provided can lie opposite the surface from which the control stick rises. The surface on which a push button is arranged can enclose an angle that includes 10° to 60°, preferably 20° to 50°, particularly with a surface on which a control stick is provided. In particular, the push button can be arranged so that an operator can actuate it easily by their index, middle, or ring finger when they are holding the input device, particularly when they grip the possibly provided protrusion.

It can be provided that a push button and a rotary adjuster can be present on the same surface at a distance from one another, wherein actuation with different fingers of an operator is particularly possible.

Essentially three surfaces can be formed on a protrusion of the input device, on each of which at least one mechanically operable actuating element is arranged. The surfaces on which a mechanically operable actuating element is provided can enclose an angle with one another. The surfaces can have a curvature. A mechanically operable actuating element designed as a rotatory adjuster can preferably be arranged on a surface having a curvature, wherein the curvature of the surface can essentially correspond to the curvature of the rotary adjuster, so that in particular the rotary adjuster can be actuated over an angular range that is greater than 180°, greater than 190°, greater than 200°, greater than 210°, greater than 220°, greater than 230°, greater than 240°, greater than 250°, greater than 260°, greater than 270°, greater than 280°, greater than 290°, or greater than 300°. This means that an operator wearing gloves can easily actuate a rotary adjuster.

A mechanically operable actuating element designed as a push button can preferably be arranged on a surface having a curvature. A push button can have a curvature that essentially corresponds to the curvature of the surface. It can be provided that actuation of the push button is possible over a larger angular range than can correspond to the angular range of the curvature. An actuation can take place even if the push button is not actuated in a straight line.

A structuring of the input device for at least partial or complete inclusion of a further device, in particular a display device, is possible, wherein an inclusion for the purposes of the description relates to a possibility of a connection between the two devices, in particular the input device and the display device, which in particular is positive-locking and/or can be force-locking.

The input device can have a surface, which is not necessarily flat, on which at least two actuating elements are arranged near two adjacent corners and/or opposite edges. The corners and/or edges can also be formed on one or more protrusions, which can be designed as handle sections. This enables two actuating elements to be arranged in an ergonomically favorable manner for the operator. The principles of optimal adaptation can thus be satisfied. User-friendly, ergonomic, or body-appropriate designs, or those that take occupational health into account, can be considered for the operator.

An operator's hand can grip around the input device near the corners and/or the edges—possibly in the area of a protrusion or several protrusions—so that one or each of the sections mentioned can be designed as a grip section. Furthermore, in the preferred embodiment, at least one actuating element can be arranged near the corners and/or the edges—possibly on one or more protrusions—so that it can be reached by the user's finger or thumb when they reach around the corners and/or the edges. It has been found here that an optimal adjustment from ergonomic points of view, in which criteria in terms of occupational health, occupational science, and user-friendliness are also included, is fulfilled. For example, the thickness of the input device's corners and/or edges can be adapted to the operator's hand, wherein it is possible to take into account that the operator is wearing gloves or no gloves.

In particular, the actuating elements arranged near the corners and/or edges can be control sticks. In particular, the control sticks can be arranged on a surface of the input device that forms a base surface or is offset parallel to it.

The input device can be designed as (a) corded and/or (b) wireless remote control. In a particularly preferred embodiment, the input device is a wireless remote control, which allows the operator to move essentially freely with the input device without having to pay attention to a cable connecting the input device to the ground drilling device. A wired remote control offers the advantage of an essentially undisturbed transmission of signals via the cable.

The input device can be configured to use one or more frequency bands for communication with the control device of the ground drilling device. For the purposes of the description, a "frequency band" means frequency ranges: partial ranges of the electromagnetic spectrum of the electromagnetic waves used for technical communication. Classifications according to frequency, wavelength, or use are common. The frequency bands might have different names, especially internationally.

The input device can have one or more antennas to provide signal paths, particularly in one direction (to make it safer to operate the ground drilling device, for example). It can be provided that signals can be bidirectionally transmitted between the input device and the control device by means of an antenna. However, it can also be provided that at least one antenna is provided for one direction (from the input device to the control device and vice versa) and that different antennas are used for the two directions. The antenna(s) can be connected to the processor of the input device.

Bidirectional communication between the input device and the control device is possible. In the case of unidirectional and/or bidirectional communication between the input device and the control device, a gateway can be (inter) connected between the input device and the control device. For example, the control device can confirm that a parameter has been entered, or transmit to the input device that an error has occurred during the input and/or transfer to the control device. The control device can transmit a signal for controlling the feedback device and for outputting the variable perceivable by the user.

The input device can have a mechanically solid structure that is adapted to part of the operator's body, particularly their finger. In this way, an input device can be created which is adapted to be user-friendly, body-appropriate, and/or supportive of occupational health, which in particular can enable fatigue-free holding without tensing the hands. A feedback device can be arranged in the mechanically fixed structure or connected to it.

An optionally available display device for displaying at least one parameter for operating the ground drilling device can be provided, wherein the display device is designed so it can optionally be mechanically connected to the input device and/or the display device can be mechanically connected to a coupling to the ground drilling device. On the one hand, this can make it possible for the display device to form a jointly manageable unit with the input device that can be held by an operator. On the other hand, this also makes it possible for the display device to be connected to the ground drilling device and the input device in turn to be connected to the display device, whereby the input device can be indirectly mechanically connected to the ground drilling device. The operation of the ground drilling device can be visualized by means of the display device. The display device can in particular be an electrical or electronic display, which can be designed in particular as a liquid crystal display (LCD), light-emitting diode (LED) matrix display, vacuum fluorescent display (VFD), or the like. In particular, an image display that is particularly intuitively understandable can be possible with the display device. The display device can be designed as a universal display instrument in the form of a screen, monitor, display, tablet, notepad, iPad, smartphone or smart display. In addition to the input device, the display device, which the operator can carry with them on site, enables the operation of the ground drilling device to be visualized regarding at least one parameter.

It can be provided that all the aforementioned parameters for operating the ground drilling device can be called up and/or displayed by means of the display device. To that end, the display can be designed so that not all parameters are displayed at the same time, but, depending on the operator's input, one or more parameters are displayed that the operator can select for the display or that are considered important and/or necessary by a command sequence of the control device for implementing and/or entering a parameter. The display device can be coupled to the input device in such a way that—if the operator wishes to enter a parameter using the input device—parameters, data, information, and/or instructions associated with this parameter are displayed on the display device. To that end, the coupling can take place by means of direct communication between the display device and the input device or by means of indirect communication between the display device and the input device, for example via the control device.

The input device can have an inner contour that is adapted to the outer contour of the display device, wherein the input device surrounds the display device at least partially along a section of the outer contour of the display device. In this way, a connection can be created between the input device and the display device in which the display device is at least partially surrounded by the input device. The display device can be provided within the input device, wherein the term "within" also includes the case that the input device does not completely surround the display device. An essentially central arrangement of the input device around the display device is possible. In particular, the input device can contact the display device on one, two, three, or four sides. A form fit and/or a frictional fit can be formed between the display device and the input device. In particular, the form fit—like the frictional fit—can optionally be released to separate the mechanical connection.

The display device can be a tablet, iPad, notepad, or the like, whereby a particularly simple design is possible. In the case of the display device, a display element that is essentially known from the prior art can be used. The aforementioned display options are known, and operators are familiar with their use. The aforementioned options for designing the display device can enable intuitive operation of the display device.

The display device and the input device can be functionally connected so that when an input is made on the input device, the input is displayed by means of the display device. The input device can transmit a signal to the display device directly or indirectly via the control device of the ground drilling device, by means of which the parameter to be changed or entered with the ground drilling device is displayed, so that the display device shows the current value of the parameter and/or the parameters connected with the parameter.

The display device can be connected (a) wirelessly or (b) wired to the control device of the ground drilling device. This makes the display device mobile. In the case of a wireless connection, the display device becomes more mobile in relation to the operator's freedom of movement.

In the communication, which is described in the description and can be present in particular between the input device and the control device, data and/or signals can be transmitted to a gateway, which in particular collects all data: not just the location data, but also the operating data and the drilling data that are recorded. The gateway can then in turn send the location data and other data that are collected to a cloud. From here, they can be called up, evaluated, and transmitted.

For the purposes of the description, the naming of a numerical value, in particular a length specification or an angle specification, includes not only the actual numerical value, but also—in order to take account of manufacturing tolerances in particular—a range around the specific numerical value, which is +/−15%, preferably +/−10%, of the specified numerical value.

The above statements, like the following description of exemplary embodiments, do not represent a waiver of specific embodiments or features.

BRIEF DESCRIPTION OF DRAWINGS

The invention is explained in more detail below using an exemplary embodiment shown in the figures.

In the drawings.

DETAILED DESCRIPTION

Figure 1:
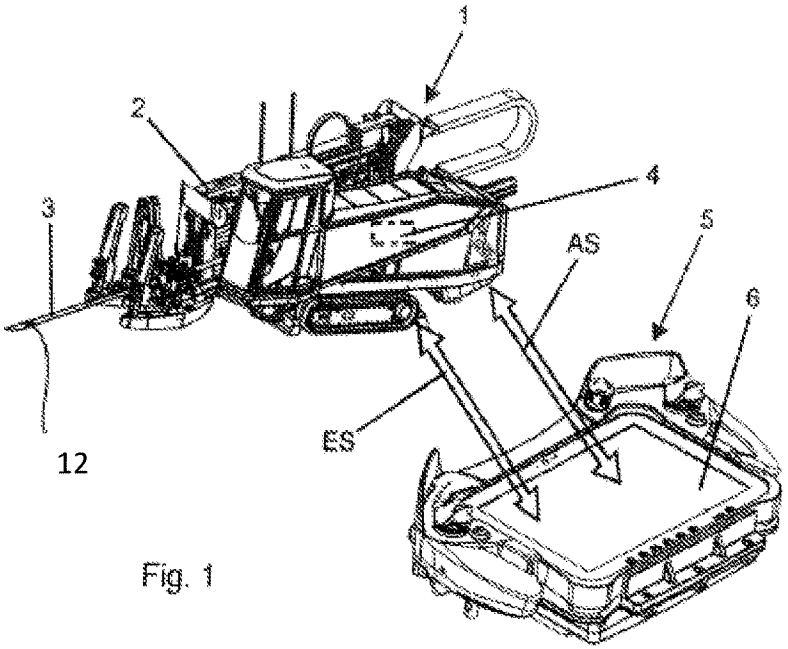
FIG. 1 shows a schematic representation of a ground drilling device with an input device.

FIG. 1 shows, in a schematic representation, a ground drilling device 1 with which ground drilling can be carried out in the ground. In a rod magazine 2, rod sections are stored with which the drill rod 3, which has already been drilled into the ground, can be extended.

The ground drilling device 1 has a control device 4 for operating the ground drilling device 1, which is shown schematically by means of the dashed box. The operation of the ground drilling device 1 can be controlled by means of the control device 4.

In addition, an input device 5 is functionally coupled to the control device 4 and is designed to input at least one parameter for operating the ground drilling device 1. In particular, such a parameter can cause the ground drilling device 1 to start or stop drilling. The input device 5 is designed as a remote control which communicates wirelessly with the control device 4 by means of electromagnetic waves.

The wireless communication between the input device 5 and the control device 4 is bidirectional communication in which the input device 5 both receives signals from the control device 4 and sends them to the control device 4. The bidirectional wireless communication is visualized with the double arrow ES.

Furthermore, a display device 6 is provided with which information and/or parameters for operating the ground drilling device 1 can be displayed. To display the information and parameters, the display device 6 is functionally coupled to the control device 4. The communication between the display device 6 and the control device 4 takes place wirelessly by means of electromagnetic waves. The communication is bidirectional, so that the display device 6 can both receive signals from the control device 4 and send them to the control device 4. The bidirectional communication is visualized with a double arrow AS.

The display device 6 can be arranged in a receiving location of the input device 5 in such a way that the display device 6 can be managed together with the input device 5 as a unit by an operator.

Figure 2:
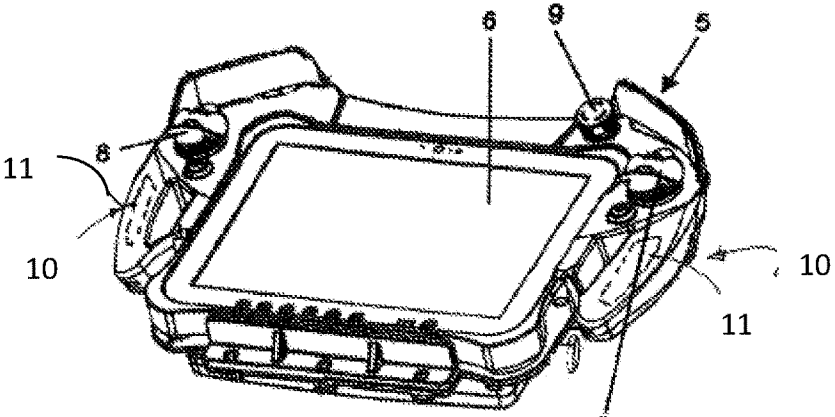
FIG. 2 shows a schematic representation of an input device in a partially sectioned representation.

In particular, FIG. 2 shows that the input device 5 has multiple mechanically operable actuating elements 8, two of which are designed as control sticks. Furthermore, the input device 5 has an emergency stop switch 9 as a mechanically operable actuating element 8 that is designed as a push button. The actuating elements 8 designed as control sticks and the emergency stop switch 9 face an operator when the input device 5 is held and are located in a plane of the input device 5. Opposite to the surface on which the control sticks and the emergency stop switch 9 are arranged, two rotary adjusters are designed as mechanically operable actuating elements 8 on the left and right of the input device 5.

On the input device 5, handle sections 10 extending from a base plate are designed as handle-like protrusions, each of which can be grasped by an operator's hand so the operator can perform the actuation. The handle sections 10 designed as protrusions extend in an upward direction and form an edge around the base plate. The handle sections 10 each form an edge on one side. The two edges that are formed by the handle sections 10 are opposite one another. On the other two sides of the rectangular input device 5 there are additional edge sections which extend upwards in the same direction as the edges which are formed by the handle sections 10. This creates an at least partially continuous edge of the input device 5 in which the display device 6 can be arranged. A force closure can be formed, wherein the display device 6 at least partially engages behind the handle sections 10 at the edges that are formed by the handle sections 10.

In each of the handle sections 10 there are feedback devices 11 which, in the embodiment shown, are designed in the form of a vibration motor. The feedback device 11 receives a signal indirectly from the control device 4. Depending on the signal, the feedback device 11 outputs, in the form of a vibration, a variable that can be tactilely perceived by the user holding the input device 5. The direction and/or strength of the vibration corresponds to a movement of the drill rod 3 and/or a movement of the ground drilling device 1. To determine the movement of the drill rod 3, a movement sensor 12 can be arranged in the drill rod. To determine the movement of the ground drilling device, a movement sensor 12 can be arranged on the ground drilling device 1.

The invention claimed is:

1. A system comprising a ground drilling device for driving a drill rod and having a control device and an input device functionally coupled to the control device for entering at least one parameter for operating the ground drilling device, wherein the input device is designed as a remote control with a feedback device which outputs a variable that is i) tactilely, ii) visually, and/or iii) auditorily perceivable by a user and that depends on:

a) the operation of the ground drilling device, b) the operating state of the ground drilling device, and/or c) the signal from a detection device, wherein the variable output corresponds to a deviation occurring that would otherwise be perceived by a user in a driver's cab of the ground drilling device, wherein the deviation is a change to the normal state of operation of the ground drilling device, wherein the change to the normal state of operation includes movement of the ground drilling device and/or the drill rod, or reaction forces caused by inserting the drill rod into the ground.

2. The system according to claim 1, further comprising a movement sensor device attached to the driver's cab of the ground drilling device and/or a carriage of the ground drilling device, wherein the movement sensor is coupled to the feedback device to send a signal relating to a movement detected on the driver's cab and/or the carriage to the feedback device.

3. The system according to claim 1, wherein the feedback device is a vibration device and the variable output is tactilely perceivable by the user.

4. The system according to claim 3, wherein the feedback device is designed to apply a continuously perceivable variable output on the input device when there is the normal state.

5. The system according to claim 1, wherein the feedback device is arranged at least partially in a grip section of the input device and the variable output is tactilely perceivable by the user via the feedback device.

6. The system according to claim 1, wherein the input device has two feedback devices which are adapted to output the variable output which is tactilely perceivable by the user.

7. The system according to claim 1, wherein the at least one parameter is a parameter that causes the ground drilling device to start drilling.

8. The system according to claim 1, wherein the variable output by the feedback device depends on the operation of the ground drilling device.

9. The system according to claim 1, wherein the variable output by the feedback device depends on the operating state of the ground drilling device.

10. The system according to claim 1, wherein the variable output by the feedback device depends on the signal from a detection device.

11. The system according to claim 1, wherein a change in the normal state is a beginning movement of a driver's cab.

12. A method for creating ground drilling by means of a ground drilling device for driving a drill rod and having a control device, wherein at least one parameter for operating the ground drilling device is entered at an input device that is coupled to the control device and that is distant from the ground drilling device, and wherein a variable is outputted that is tactilely perceivable by a user and that depends on:

a) the operation of the ground drilling device, b) the operating state of the ground drilling device, and/or c) the signal from a detection device, wherein the variable output corresponds to a deviation occurring that would otherwise be perceived by a user in a driver's cab of the ground drilling device, wherein the deviation is a change to the normal state of operation of the ground drilling device, wherein the change to the normal state of operation includes movement of the ground drilling device and/or the drill rod, or reaction forces caused by inserting the drill rod into the ground.

13. The method according to claim 12, wherein the at least one parameter is a parameter that causes the ground drilling device to start drilling.

14. The method according to claim 12, wherein the variable output depends on the operation of the ground drilling device.

15. The method according to claim 12, wherein the variable output depends on the operating state of the ground drilling device.

16. The method according to claim 12, wherein the variable output depends on the signal from the detection device.

17. The method according to claim 12, further comprising sensing movement on the drill rod and/or the ground drilling device and outputting a signal relating to said sensed movement.

18. The method according to claim 17, wherein sensing movement on the drill rod and/or the ground drilling device comprises sensing vibrations on the drill rod and/or the ground drilling device.

19. The method according to claim 17, further comprising applying a continuously perceivable variable on the input device when the drill rod is moved.

20. The method according to claim 12, further comprising arranging the feedback device at least partially in a grip section of the input device.

* * * * *